US007421958B2

(12) United States Patent
Ciulla

(10) Patent No.: US 7,421,958 B2
(45) Date of Patent: Sep. 9, 2008

(54) APPARATUS AND METHOD FOR PROVIDING A WORKSPACE

(76) Inventor: Tom Ciulla, P.O. Box 2157, Jackson, WY (US) 83001

( * ) Notice: Subject to any disclaimer, the term of this patent is extended or adjusted under 35 U.S.C. 154(b) by 273 days.

(21) Appl. No.: 11/042,327

(22) Filed: Jan. 24, 2005

(65) Prior Publication Data

US 2006/0162623 A1 Jul. 27, 2006

Related U.S. Application Data

(63) Continuation-in-part of application No. 11/040,487, filed on Jan. 21, 2005, now abandoned.

(51) Int. Cl.
*A47B 23/00* (2006.01)

(52) U.S. Cl. ..... 108/44

(58) Field of Classification Search ..... 190/11, 190/12 A, 900–902; 108/42–44, 48, 35, 108/36, 134, 135, 152; 312/245, 248
See application file for complete search history.

(56) References Cited

U.S. PATENT DOCUMENTS 1,491,807 A * 4/1924 Mclinn ..... 190/11
1,578,778 A * 3/1926 Thornhill ..... 190/11
1,588,759 A 6/1926 Lewis
1,632,268 A * 6/1927 Berry ..... 108/42
2,667,353 A * 1/1954 Lanice ..... 273/286
2,837,394 A 6/1958 Rahall
D191,272 S * 9/1961 Ungaro ..... D6/429
3,032,916 A * 5/1962 Oakes ..... 108/41
3,994,372 A 11/1976 Geller et al.
4,466,659 A * 8/1984 Carpentier et al. ..... 297/188.06
4,843,662 A * 7/1989 Handelman ..... 5/653
4,889,057 A * 12/1989 Chartrand ..... 108/42
4,901,901 A * 2/1990 Reitenour ..... 224/277
4,919,498 A 4/1990 Turner
4,998,484 A 3/1991 Groetzinger
5,046,433 A * 9/1991 Kramer et al. ..... 108/44
5,067,417 A 11/1991 Marmentini et al.
5,131,513 A 7/1992 Gossage
5,205,610 A * 4/1993 Reninger ..... 297/380

(Continued)

OTHER PUBLICATIONS

WWW.DULUTHTRADING.COM, "The Duluth Trading Plans Protector," at least as early as Oct. 28, 2004.

*Primary Examiner*—Janet M Wilkens
(74) *Attorney, Agent, or Firm*—Clayton, Howarth & Cannon, P.C.

(57) ABSTRACT

A portable and wall mountable apparatus comprising a flexible case having one or more internal compartments for removably receiving stiffeners to thereby form a pair of panels. The panels are pivotally joined and fold shut against each other to form a portable carrier for articles such as architectural plans and the like. Handles are attached to the flexible case to facilitate transport. A plurality of tabs with grommets are attached to the flexible case to allow the panels to be removably mounted to a wall such that one of the panels may be used as a desktop or workspace. One or more restraining devices suspend the panel being used as a desktop or workplace in a horizontal position when the case is mounted to a wall. The flexible case may also be conveniently stored by removing the stiffeners when not in use and rolling up the shell into a compact shape.

16 Claims, 7 Drawing Sheets

U.S. PATENT DOCUMENTS 5,281,019 A 1/1994 Rodeck
5,315,935 A 5/1994 Weisenfels
5,421,499 A * 6/1995 Bauer ..... 224/270
5,469,967 A * 11/1995 Boorady ..... 206/527
5,513,574 A 5/1996 Collins
5,535,683 A 7/1996 Novak
5,551,558 A 9/1996 Bureau
5,558,026 A * 9/1996 Seibert ..... 108/44
5,642,674 A * 7/1997 Joye et al. ..... 108/43
5,722,586 A 3/1998 Hansen
5,878,672 A * 3/1999 Ostermann et al. ..... 108/44
6,039,416 A 3/2000 Lambert
6,101,086 A * 8/2000 Kim et al. ..... 361/683
6,193,118 B1 * 2/2001 Kearl ..... 224/153
6,289,824 B1 9/2001 Parker et al.
6,513,443 B2 2/2003 Todd
6,729,685 B1 5/2004 Ebalobor
6,763,986 B2 * 7/2004 Santos et al. ..... 224/585
6,772,883 B2 8/2004 Lindamood
2001/0039903 A1 * 11/2001 Patterson ..... 108/44
2002/0069793 A1 6/2002 Clores
2002/0189508 A1 12/2002 Tood
2004/0032190 A1 2/2004 Condas
2006/0032410 A1 * 2/2006 Miller ..... 108/44
2006/0137578 A1 * 6/2006 Noding ..... 108/152

* cited by examiner

APPARATUS AND METHOD FOR PROVIDING A WORKSPACE

CROSS-REFERENCE TO RELATED APPLICATIONS

This application is a continuation-in-part of U.S. patent application Ser. No. 11/040,487, filed Jan. 21, 2005 now abandoned, entitled "Apparatus and Method for Providing a Workspace," which is hereby incorporated by reference herein in its entirety, including but not limited to those portions that specifically appear hereinafter, the incorporation by reference being made with the following exception: In the event that any portion of the above-referenced application is inconsistent with this application, this application supercedes said above-referenced application.

STATEMENT REGARDING FEDERALLY SPONSORED RESEARCH OR DEVELOPMENT

Not Applicable.

BACKGROUND

1. The Field of the Invention

The present disclosure relates generally to portable workbenches and desks, and more particularly, but not necessarily entirely, to a portable workspace, one version of which is wall-mountable and formed of a flexible outer material capable of providing a combination workspace and carrier.

2. Description of Related Art

Portable tables and workbenches are well known and popular devices for conveniently providing a workspace at a desired location. These devices typically comprise one or more pair of collapsible legs attached to a top. While useful for there intended purposes, these devices often prove unsatisfactory in certain settings. Principally, these devices are known to be in some instances cumbersome and unmanageable both in transport and storage. For example, these devices are usually not transportable in a standard sized car but instead require a truck or a trailer. Even when a truck or a trailer is available, the devices may occupy too much space if other items are being transported as well.

Examples of previously available portable tables and workbenches are found in the following references. U.S. Pat. No. 6,289,824 (granted Sep. 18, 2001 to Parker et al.) discloses a collapsible jobsite plan table that is collapsible and adjustable and that is made of plastic or other lightweight material. U.S. Pat. No. 5,281,019 (granted Jan. 25, 1994 to Rodeck) discloses a foldable plan stand case having detachable legs for supporting the case in the open position. U.S. Pat. No. 5,067,417 (granted Nov. 26, 1991 to Marmentini et al.) discloses a foldable table including to half sections pivotally joined together.

Another disadvantage to portable tables and workbenches is that they are often not suitable for use at certain locations, such as a construction job site. This is due to the fact that if a dedicated space for these devices is not available, they are often in the way and must constantly be moved or taken down in order to not interfere with construction. Another drawback to portable tables and workbenches is that they generally do not provide a storage area when collapsed or during transport. It would be useful to provide a storage area for articles such that Other previously known devices for providing a workspace include wall mountable devices having a fold down table which may be opened to a horizontal position for use or closed to a vertical position when not in use. These wall mountable device may include interior storage compartments and the like. These wall mountable devices are generally constructed using a box and frame construction that results in only a slight improvement, if any, over the convenience of standard portable tables and workbenches. In particular, the materials and construction of known wall mountable devices may actually make them heavier and more cumbersome than portable tables and workbenches.

Examples of previously available wall mountable devices are found in the following references. U.S. Pat. No. 6,039,416 (granted Mar. 21, 2000 to Lambert) discloses a pivotal work bench assembly that is mountable on a wall and that includes pivotal and lockable legs. U.S. Pat. No. 5,513,574 (granted May 7, 1996 to Collins) discloses a wall mountable folding table apparatus which is contained in a cabinet having a pair of folding doors into which the table is folded and stored. U.S. Pat. No. 4,919,498 (granted Apr. 24, 1990 to Turner) discloses a portable and wall mountable desk including extendable legs.

The previously available devices are thus characterized by several disadvantages that are addressed by the present disclosure. The present disclosure minimizes, and in some aspects eliminates, the above-mentioned failures, and other problems, by utilizing the methods and structural features described herein.

The features and advantages of the disclosure will be set forth in the description which follows, and in part will be apparent from the description, or may be learned by the practice of the disclosure without undue experimentation. The features and advantages of the disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
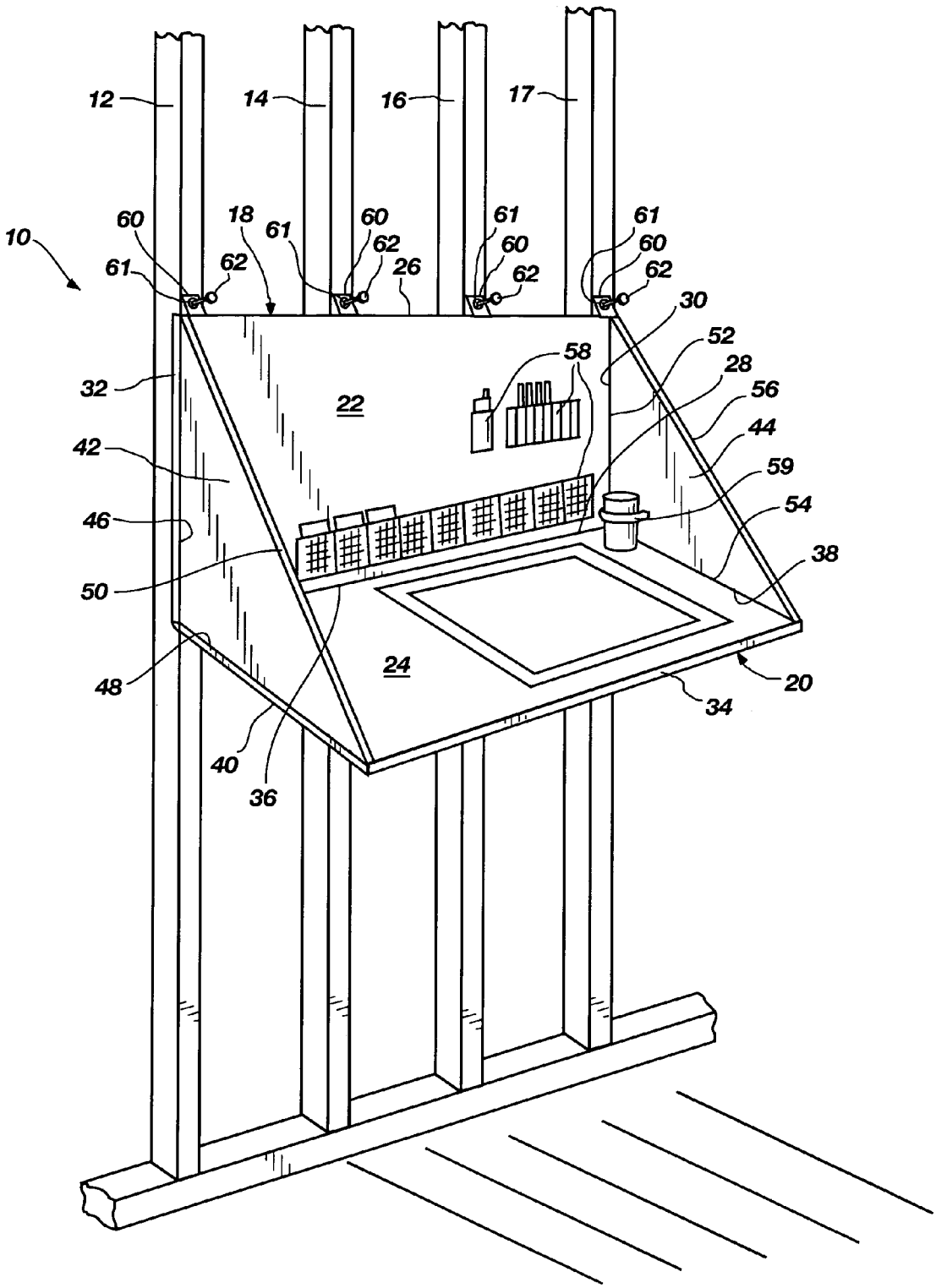
FIG. 1 is a perspective view of one exemplary embodiment of the present disclosure mounted on a wall and in an open position.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

It must be noted that, as used in this specification and the appended claims, the singular forms "a," "an," and "the" include plural referents unless the context clearly dictates otherwise. In describing and claiming the present disclosure, the following terminology will be used in accordance with the definitions set out below. As used herein, the terms "comprising," "including," "containing," "characterized by," and grammatical equivalents thereof are inclusive or open-ended terms that do not exclude additional, unrecited elements or method steps.

Applicant has discovered a multi-purpose apparatus that provides an instant and efficient place to work at a job site, a home workshop or any other desirable location. The apparatus may also function as a document carrier similar to an artist portfolio. Applicant's apparatus may comprise a flexible case formed of a light weight and thin material. A pair of internal compartments may be formed within the flexible case to receive a pair of stiffeners, such as plywood, to form an internal support structure for the apparatus. In particular, the pair of stiffeners may form a pair of panels that are operable between an open position and a closed position. While the outer case is mounted on a wall, one of the panels may function as a work area or desk top. In addition, storage pockets allow various items to be easily stored. In the closed position, an inside face of each of the pair of panels may jointly form a storage area for items such as architectural plans and the like. A handle attached to the flexible case may also allow the entire apparatus to function as a document carrier while the panels are in the closed position. Advantageously, the pair of stiffeners may be removed to thereby allow the flexible case to be easily transported and stored by collapsing and rolling up the case to a compact size.

Referring now to FIG. 1, there is shown a perspective view of a portable and wall mountable apparatus 10 in accordance with one exemplary embodiment of the present disclosure. The apparatus 10 is shown in an open position, and may be mounted as shown to an unfinished or framed wall comprising a plurality of vertically extending studs having reference numerals 12 through 17. It should be understood, however, that the apparatus 10 may be mounted to any type of structure.

The apparatus 10 includes a flexible case formed by a pair of panels 18 and 20 pivotally interconnected such that the panels 18 and 20 may be moveable between an open position and a closed position. As shown FIG. 1, the panel 20 may be opened to a substantially horizontal position such that its inside face 24 may function as a work area, workbench or desk top. The inside face 24 may be referred to herein as a "workspace section," the term "workspace section" meaning a space in which all portions of the workspace are disposed in a fixed orientation relative to each other, though the workspace section itself may be moveable relative to others parts of the apparatus 10. The panel 18 is shown mounted in a vertical position and adjacent to studs 12 through 17 such that its inside face 22 may serve as a back to the work area provided by the inside face 24 of the panel 20.

The panels 18 and 20 may be sized and shaped to any size depending upon the needs of the user. The panels 18 and 20, for example, may vary between about three (3) to eight (8) feet (0.91 meters to 2.4 meters) long, and about two (2) to five (5) feet (0.61 meters to 1.5 meters) wide. The panels 18 and 20 may formed in a generally rectangular shape.

The panel 18 further comprises an outermost edge 26 and an innermost edge 28 and two opposing side edges 30 and 32. The panel 20 also further comprises an outermost edge 34 and an innermost edge 36 and two opposing side edges 38 and 40. As previously mentioned, the panel 18 and the panel 20 are pivotally interconnected along their respective innermost edges 28 and 36. Due to the pivotal relationship between panels 18 and 20, a pair of retraining devices 42 and 44 may be employed to suspend and maintain the panel 20 in an elevated and lateral orientation or a substantially horizontal orientation against the force of gravity. Without the restraining devices 42 and 44, the result may be undesirable as the panels 18 and 20 would open without restriction to 180 degrees with respect to each other.

Figure 6:
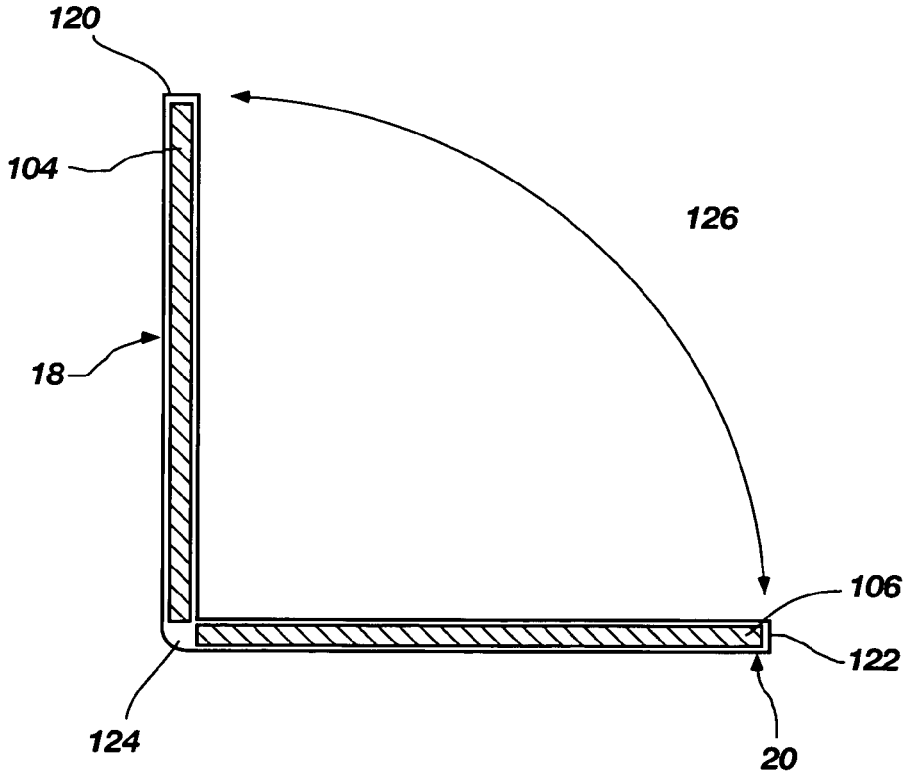
FIG. 6 is a cross-sectional view of pivotally interconnected panels.

A cross-sectional view of the pivotal interconnection of the panels 18 and 20 is shown in FIG. 6. The panel 18 comprises a flexible outer shell 120 enclosing a stiffener 104. The stiffener 104 may either be removable, or non-removable if its encapsulating shell 120 is sewn shut or otherwise sealed to block removed of said stiffener 104. The panel 20 also comprises a flexible outer shell 122 enclosing a stiffener 106. The stiffener 106 may also be removable or non-removable. The flexible outer shells 120 and 122 of the panels 18 and 20, respectively, are interconnected by a flexible bridge portion 124. The bridge portion 124 may also be formed of a flexible material to thereby allow the panels 18 and 20 to pivot or swing with respect to each other as shown by the line indicated with the reference numeral 126. Notably the bridge 124 and the flexible outer shells 120 and 122 may all be made of the same material.

The restraining devices 42 and 44 may each be substantially triangular in shape and formed of a flexible material. The restraining device 42 may include a first edge 46 attached to the side edge 32 of the panel 18 and a second edge 48 attached to the side edge 40 of the panel 20. The first edge 46 and the second edge 48 may intersect to form a right angle near the pivotal interconnection between the panels 18 and 20. A third edge 50 of restraining device 42 may extend from the outermost edge 26 of the panel 18 to the outermost edge 34 of the panel 20.

Likewise, the restraining device 44 may include a first edge 52 attached to the side edge 30 of the panel 18 and a second edge 54 attached to the side edge 38 of the panel 20. The first edge 52 and the second edge 54 may intersect to form a right angle near the pivotal interconnection between the panels 18 and 20. A third edge 56 of the restraining device 44 may extend from the outermost edge 26 of the panel 18 to the outermost edge 34 of the panel 20.

It will be appreciated by those skilled in the art that other types of restraining devices may be used with the present disclosure to support the weight of one of the panels. For example, one or more tethers could be employed to support one of the panels in a substantially horizontal position. In addition, a brace formed from a rigid material such as wood or metal could also be employed to hold one of the panels in a substantially horizontal position. In addition, the pivotal interconnection between the panels 18 and 20 could incorporate a restraining device to stop movement of the panels at about 90 degrees with respect to each other. Also, any type of restraining device anchored to a fixed point and supporting the weight of one of the panels, either separately or in combination with another device, should be considered within the scope of the present disclosure.

It will be further appreciated that the present disclosure may not require the use of legs to support one of the panels in a substantially horizontal position. The use of restraining devices to suspend one of the panels from a wall in a substantially horizontal position is a primary feature of the present invention. However, it must be noted that the use of legs to hold one of the panels in a substantially horizontal position is not outside the scope of the present disclosure.

Figure 4:
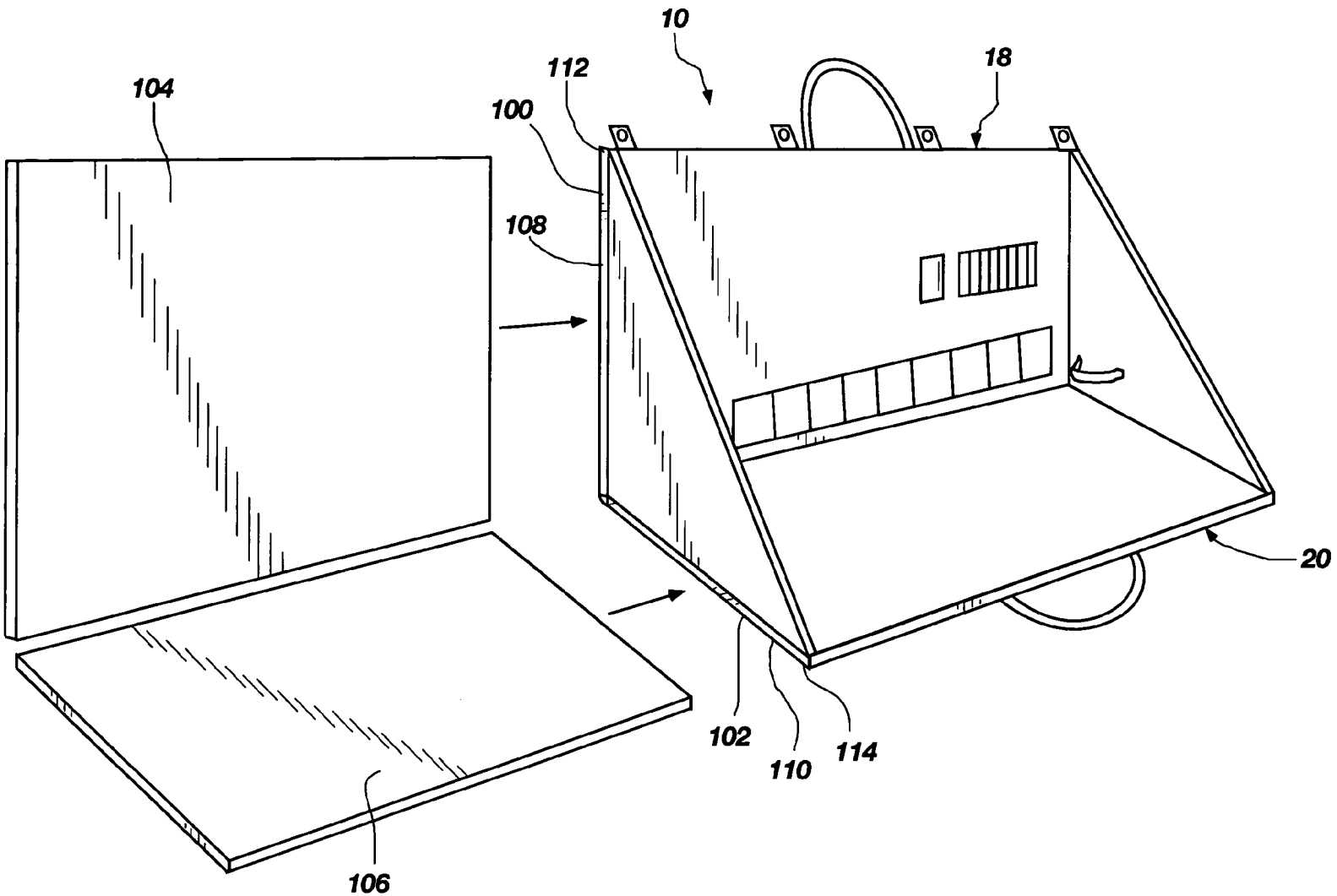
FIG. 4 is a perspective view of the exemplary embodiment shown in FIG. 1 illustrating the removable stiffeners.

Referring now to FIG. 4, each of the panels 18 and 20 may include a pair of internal compartments 100 and 102 enclosing the pair of stiffeners 104 and 106, respectively. As used herein, the term "enclosed" means to cover or encapsulate either partially or entirely one of the stiffeners. A pair of openings 108 and 110 may allow the stiffeners 104 and 106 to be selectively inserted and removed from the compartments 104 and 106, respectively.

The opening 108 may or may not include a closure device 112, such as a zipper, for closing the opening 108 and preventing the accidental removal of the stiffener 104. Likewise, the opening 110 may also include a closure device 114, such as a zipper, for closing the opening 110 and preventing the accidental removal of the stiffener 106. Other closure devices may include, without limitation, velcro strips, snaps, buttons, and other similar devices. Thus, it will be appreciated that the closure devices 112 and 114 may include any type of closure device now known or known in the future by those skilled in the art.

The internal compartment 100 is located within panel 18 and the internal compartment 102 is located within panel 20. The internal compartments 100 and 102 are approximately the same size as panels 18 and 20, respectively. The stiffeners 104 and 106 provide an internal support for panels 18 and 20. Without the stiffeners 104 and 106, the panels 18 and 20, respectively, would be flaccid and unable to function as described above. This result is due to the flexible nature of the outer shells 120 and 122.

It should be noted that the stiffeners 104 and 106 may be permanently installed into their respective internal compartments 100 and 102 or they may be temporarily installed; both cases which fall within the scope of the present disclosure. In one desired embodiment, an apparatus produced pursuant to the present disclosure is produced and sold without any stiffeners for the panels. A user may then provide and install the stiffeners when needed. This may include having the user cut a piece of ⅝ inch (0.59 centimeters) plywood or similar material to form the stiffeners 104 and 106.

The foregoing feature is beneficial for several reasons. First, the manufacturer is not burdened with the costs and size associated with producing the stiffeners thereby allowing an apparatus conforming to the present disclosure to be marketed in a more compact and less costly manner. Next, the user may insert the stiffeners on-site thereby reducing the transport and storage space to the use when not in use. Further, since material required for the rigid panels, namely plywood, is readily available at most job sites the user may acquire and discard the stiffeners as needed. It should also be noted that other materials of both a rigid and semi-rigid nature may be used, including all manufactured materials such as plastic.

Referring back to FIG. 1, a plurality of storage pockets 58 may be disposed on the inside face 22 of the panel 18. The storage pockets 58 allow useful items such as business cards, cell phones, pens, tools, pencils and other supplies to be conveniently stored and transported. The storage pockets 58 may be formed of a flexible material such as an elastic mesh material and may be positioned in any convenient location on the inside face 22 of panel 18. A drink holder 59 may also be provided for soda pop cans or refillable mugs. The drink holder 59 may be formed of an elastic and flexible material.

A plurality of fasteners may be disposed along the outermost edge 26 of the panel 18 for removably mounting the apparatus 10 to a wall. The fasteners may each comprise a tabbed portion 60 having hole 61 which may be reinforced by a grommet. The fasteners may be spaced about sixteen (16) inches (0.41 meters) apart to correspond to the typical spacing of studs 12 through 17 found at a normal construction site. It is to be understood, however, that the spacing between studs may vary significantly, and the fasteners may be positioned to accommodate other configurations. A cross piece (not shown) may be attached horizontally across non-conforming studs to provide points of attachments for the fasteners.

The apparatus 10 may be mounted by installing the holes 61 in each of the tabbed portions 60 over nails 62 previously driven into each of the studs 12 through 17. The apparatus 10 may be removed from the wall by simply removing the tabbed portions 60 from the nails 62. It will be appreciated by those skilled in the art that any type of fasteners now known or known in the future may be employed to mount an apparatus pursuant to the present disclosure to a wall. Further, it should be understood that the fasteners may be employed singly or multiply to accomplish the function of mounting an apparatus pursuant to the present disclosure to a wall. It should also be noted that the fasteners may permanently or temporarily mount an apparatus pursuant to the present disclosure to a wall depending upon the needs of a user.

Figure 2:
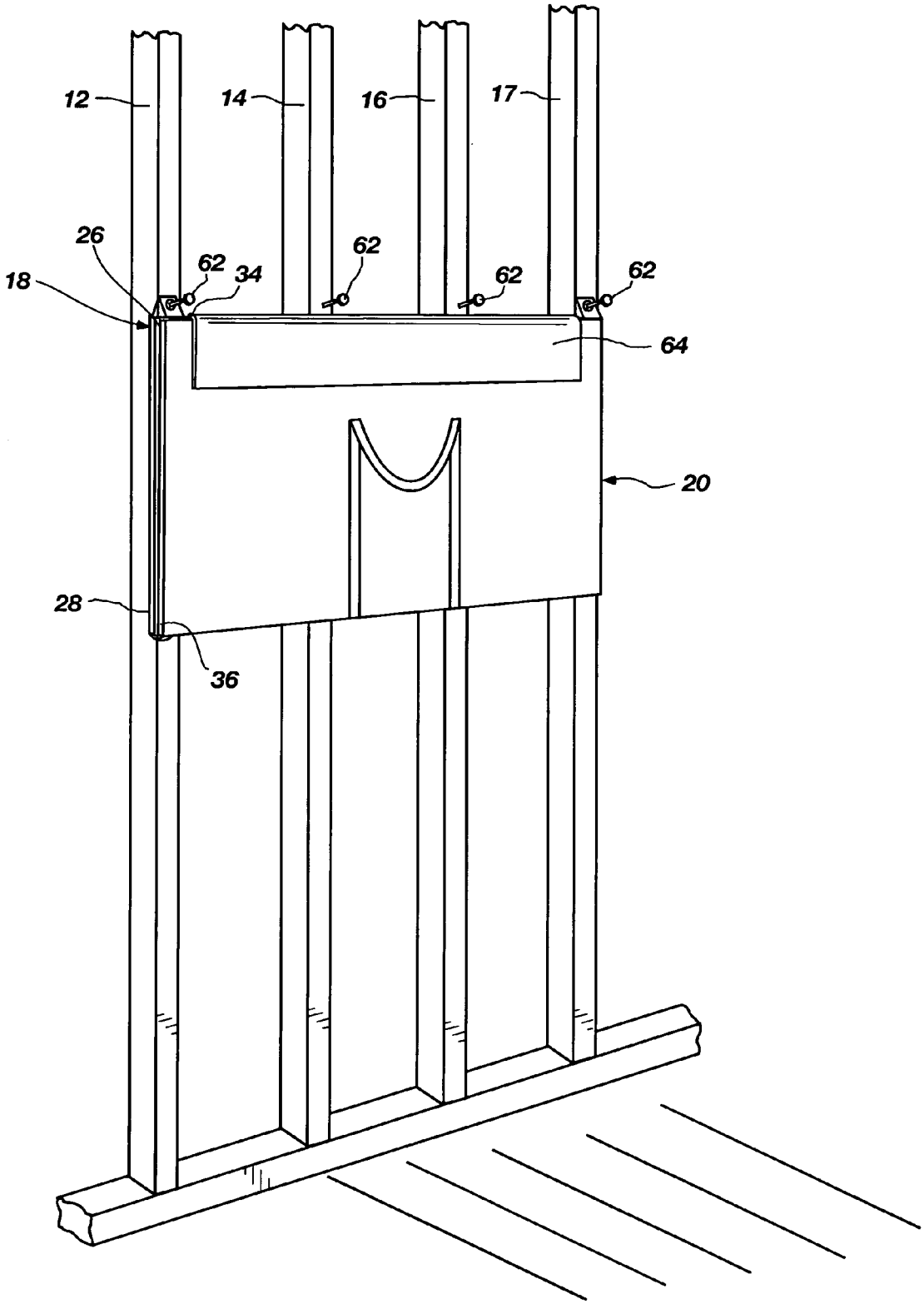
FIG. 2 is a perspective view of the exemplary embodiment shown in FIG. 1 mounted on a wall in a closed or upright position.
Figure 3:
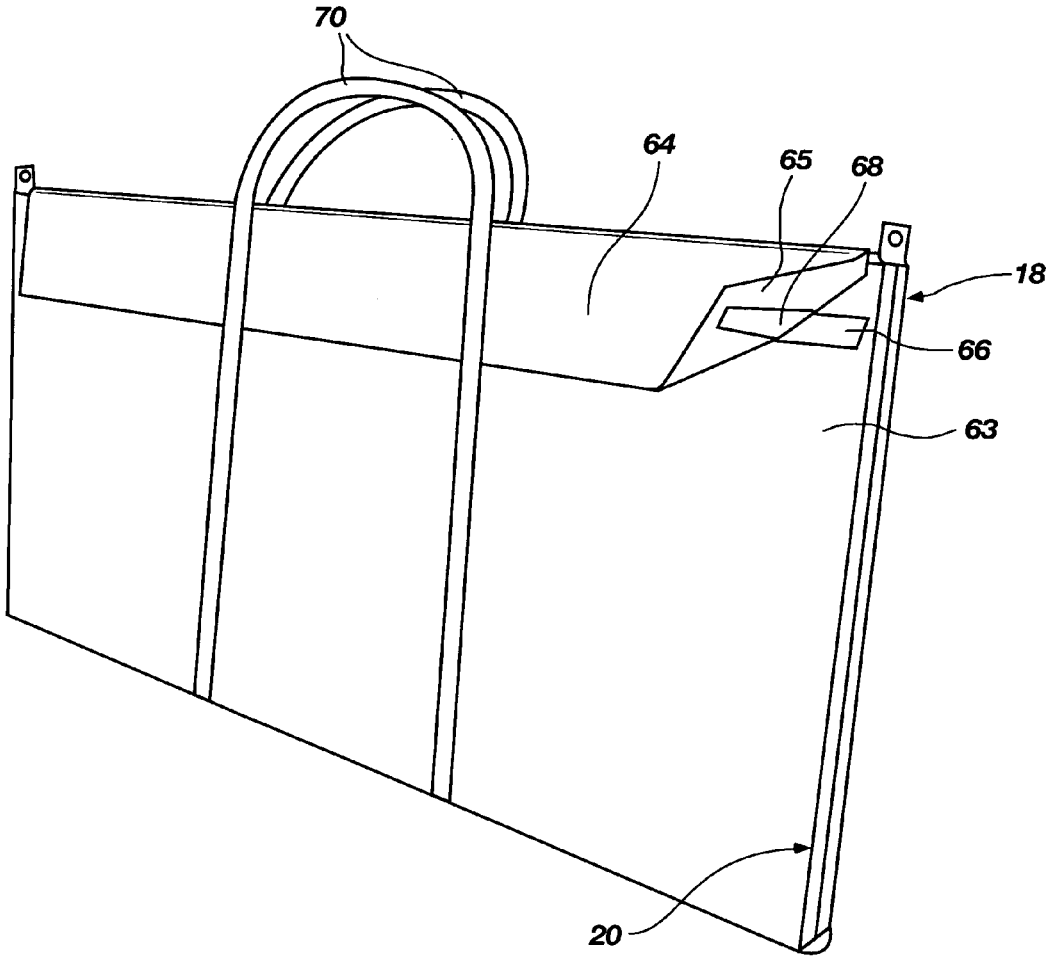
FIG. 3 is a perspective view of the exemplary embodiment shown in FIG. 1 in a closed.

Referring now to FIGS. 2 and 3, there is shown the apparatus 10 having the panels 18 and 20 in a closed or upright position. As discussed above, the panels 18 and 20 are pivotally interconnected along their respective innermost edges 28 and 26. As can be observed, in a closed or upright position, the inside faces 22 and 24 of the panels 18 and 20, respectively, are pivotally swung into close proximity.

A flap 64 affixed to the outside face (not explicitly shown) of panel 18 is folded over the outermost edges 26 and 34 of panels 18 and 20, respectively, and secured to the outside face 63 of the panel 20. As best seen in FIG. 3, a velcro strip 68 attached to an inside surface 65 of flap 64 mates with a corresponding velcro strip 66 attached to the outside face 63 of the panel 20 in order to secure the panels 18 and 20 in the closed or upright position. The flap 64 may be formed of a flexible material.

It will be appreciated that the structure and apparatus disclosed herein is merely one example of a means for securing the workspace section in a vertical orientation, and it should be appreciated that any structure, apparatus or system for a securing the workspace section in a vertical orientation which performs functions the same as, or equivalent to, those disclosed herein are intended to fall within the scope of a means for securing the workspace section in a vertical orientation, including those structures, apparatus or systems for securing the workspace section in a vertical orientation which are presently known, or which may become available in the future. Anything which functions the same as, or equivalently to, a means for securing the workspace section in a vertical orientation falls within the scope of this element.

Figure 1A:
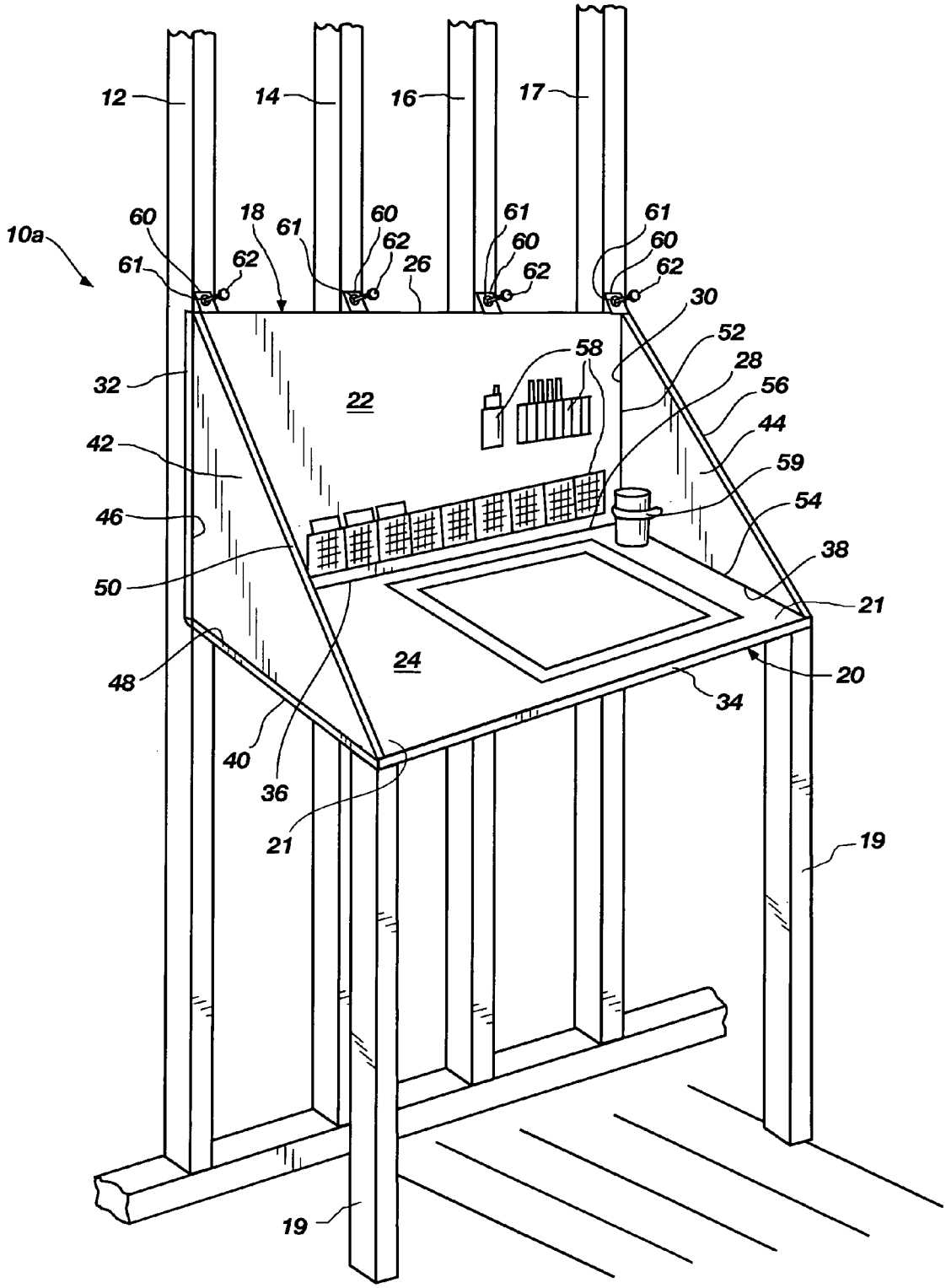
FIG. 1A is a perspective view of an alternative embodiment of the embodiment of FIG. 1, showing a wall-mounted portable workspace having front legs.

Referring now to FIG. 1A, there is shown an alternative embodiment to the apparatus 10 of FIG. 1, designed generally in FIG. 1A as item 10*a*. A principal difference between the apparatus 10 of FIG. 1, and the apparatus 10*a* of FIG. 1A, is the addition of front legs 19 in apparatus 10*a*. Legs 19 may be attached beneath front corner sections 21 of panel 20, in any suitable fixed or releasable manner desired and known. The addition of legs 19 entirely optional, and is not required.

As seen in FIG. 2, advantageously, the panel 20 may be closed while the apparatus 10 is still mounted to the studs 14 through 17. It may be necessary, however, to unhook the middle tabbed portions 60 from the nails 62 on studs 14 and 16 to thereby enable the flap 64 to be employed to secure the panels 18 and 20 in the closed or upright position. So engaged, the flap 64 may prevent water and other undesirable material from entering between the panels 18 and 20, especially during inclement weather common at job sites.

It should be understood by those skilled in the art that it is within the scope of the present disclosure that other devices and structure now known or known in the future may be used to secure, fasten or maintain the panels 18 and 20 in a closed or upright position. These other devices and structure, may include, without limitation, straps, latches, snaps, zippers, clips, velcro, elastic cords, cinch straps and the like. Indeed, any suitable closure device, consistent with maintaining the features described herein, may be used to secure the panels 18 and 20 in a closed position.

As seen in FIG. 3, a pair of handles 70 may allow the apparatus 10 to function as a portable document carrier when the apparatus 10 is removed from the studs 12 through 17. In that regard, it will be noted that a pocket may be formed between the panels 18 and 20 while they are in the closed or upright position. This pocket will allow items such as architectural plans and the like to be protected during transport. The handles 70 may be formed of nylon straps or any other suitable material. The handles 70 may be connected to flexible outer shells 120 and 122 of the panels 18 and 20.

When the panels 18 and 20 of the apparatus 10 are in the closed or upright position, the restraining devices 42 and 44 fold neatly into the area between the panels 18 and 20 due to their flexible nature. In this manner, the restraining devices 42 and 44 are conveniently stored in an out of the way location. Further, the folded up restraining device 42 and 44 prevent water and other debris from entering between the panels 18 and 20. When the panels 18 and 20 are opened, the restraining devices 42 and 44 deploy to thereby suspend the panel 20 in a substantially horizontal position.

Figure 5:
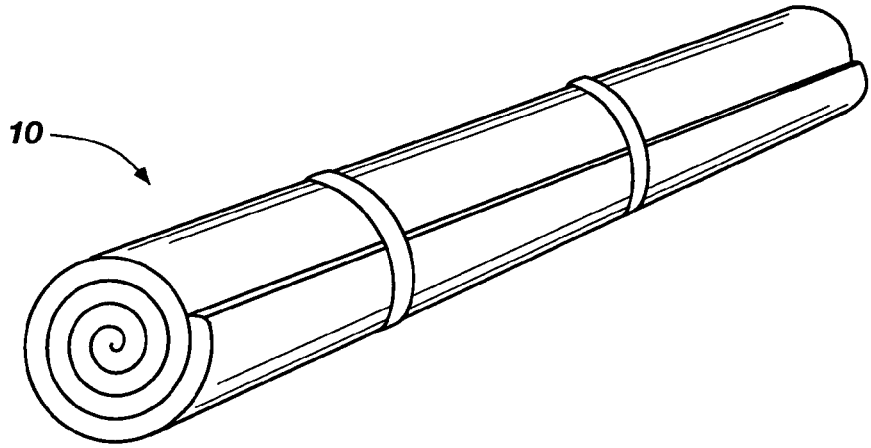
FIG. 5 is a perspective view of the exemplary embodiment shown in FIG. 1 in a rolled up position.

With the stiffeners 104 and 106 installed into the internal compartments 100 and 102, respectively, the apparatus 10 may be employed as discussed above, including mounting the apparatus 10 on a wall as shown in FIGS. 1 and 2, or the apparatus 10 may be used as a portable document carrier as shown in FIG. 3. When the stiffeners 104 and 106 are removed from the internal compartments 100 and 102, respectively, the apparatus 10 may be rolled up into a compact position as shown in FIG. 5. While in the compact position, the apparatus 10 may be easily transported or stored until needed.

As detailed above, many of the features of the present disclosure incorporate the use of a flexible material. This flexible material may include a flexible material that is waterproof or water resistant. Further, the flexible material may include any type of manufactured fiber, fabric, cloth, nylon, polyethylene, and canvass. In one exemplary embodiment, the flexible material may include Cordova or any other light weight and durable material.

In accordance with the features and combinations described above, a useful method of providing a portable workspace includes the steps of:

(1) providing a flexible case having at least one internal compartment and at least one fastening device for removably mounting the flexible case to a structure;
(2) inserting a first stiffener into one of the internal compartments in the flexible case;
(3) mounting the flexible case to a structure; and
(4) opening the flexible case such that the internal compartment containing the first stiffener may function as a workspace section.

Those having ordinary skill in the relevant art will appreciate the advantages provide by the features of the present disclosure. For example, it is a feature of the present disclosure to provide a portable apparatus and method for providing a workspace. Another feature of the present disclosure is to provide such a flexible case having internal compartments for removably receiving a pair of stiffeners. It is a further feature of the present disclosure, in accordance with one aspect thereof, to provide an apparatus that may function as both a wall mountable workspace and a portable document carrier.

Figure 7:
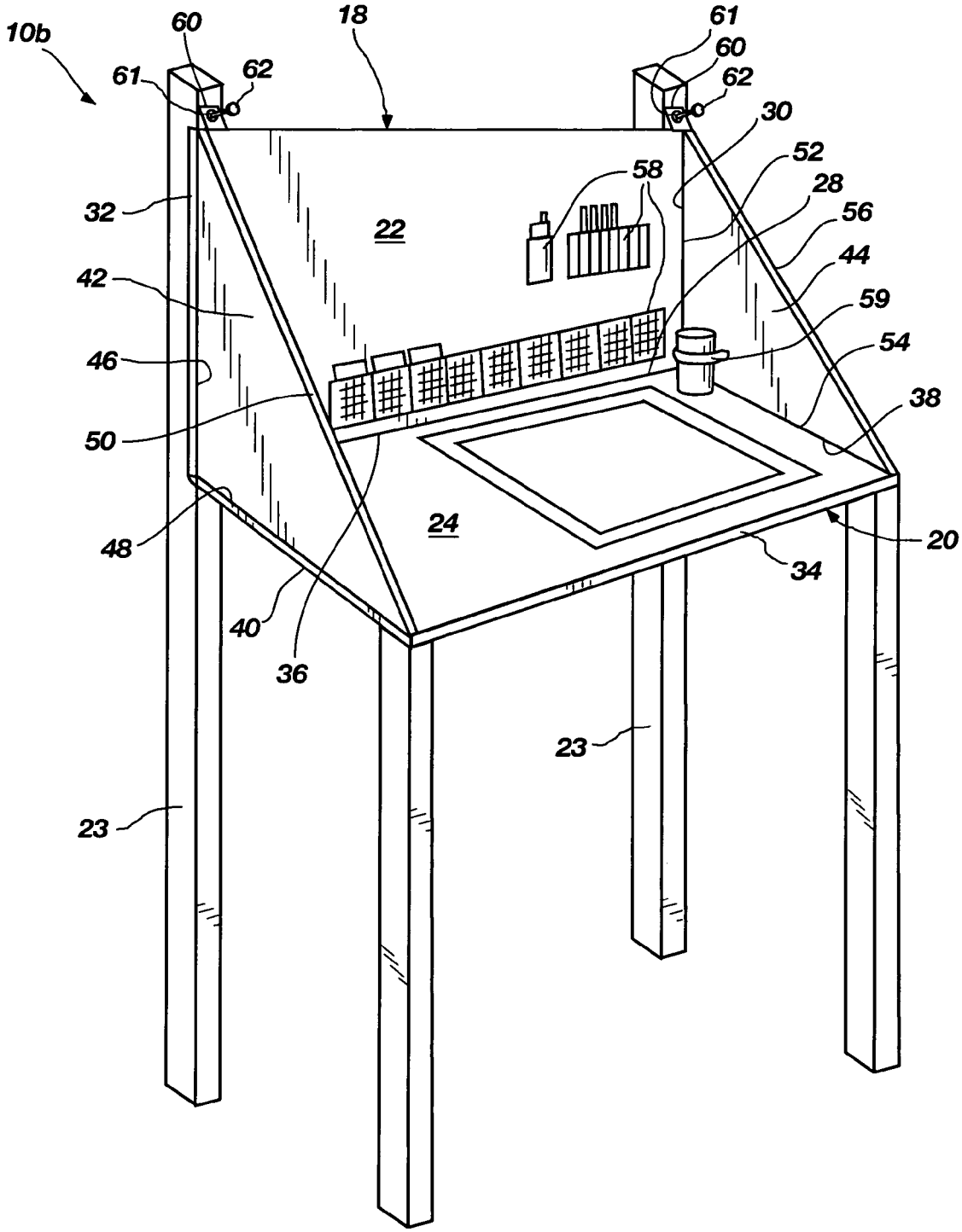
FIG. 7 is a perspective view of an alternative embodiment of the embodiment of FIGS. 1 and 1A, showing a free-standing workspace having rear legs and front legs.

Referring now to FIG. 7, there is shown another alternative embodiment to the apparatus 10 of FIG. 1 and the apparatus 10*a* of FIG. 1A, designed generally in FIG. 7 as item 10*b*. A principal difference in the apparatus 10*b* of FIG. 7 is that it is a free-standing apparatus, including the addition of front legs 19, as well as rear legs 23. Tabbed portions 60 may simply be placed over a nail 62 or other projection fastened to rear legs 23, to support a rear section of the apparatus 10*b*. Any other suitable means for supporting the apparatus 10*b* in an elevated position, whether by utilizing rear legs 23 or some other version of rear legs not shown herein, may be utilized. Front legs 19 may be attached beneath front corner sections 21 of panel 20, in any suitable fixed or releasable manner desired and known. The use of rear legs 23 or other suitable support, instead of studs 12, 14, 16 and 17 of FIG. 1, is entirely optional, and is not required. The use of front legs 19 is also entirely optional, and is not required.

It will be appreciated that the structure and apparatus disclosed herein are merely some examples of means for suspending the workspace section in an elevated, lateral orientation, and it should be appreciated that any structure, apparatus or system for suspending the workspace section in an elevated, lateral orientation which performs functions the same as, or equivalent to, those disclosed herein are intended to fall within the scope of a means for suspending the workspace section in an elevated, lateral orientation, including those structures, apparatus or systems for suspending the workspace section in an elevated, lateral orientation which are presently known, or which may become available in the future. Anything which functions the same as, or equivalently to, a means for suspending the workspace section in an elevated, lateral orientation falls within the scope of this element.

In the foregoing Detailed Description, various features of the present disclosure are grouped together in multiple embodiments. This disclosure is not to be interpreted as reflecting an intention that the claimed disclosure requires more features than are expressly recited in each claim. Rather, as the following claims reflect, inventive aspects lie in less than all features of any of the foregoing disclosed embodiments. Thus, the following claims are hereby incorporated into this Detailed Description of the Disclosure by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A method for providing a wall mountable workspace on a construction site, the method comprising the steps of:

providing a flexible case having at least two internal compartments and at least one pair of fastening devices for removably mounting the flexible case to a structure, said at least one pair of fastening devices mounted to and above an upper edge of the flexible case;

inserting a first stiffener into one of the at least two internal compartments in the flexible case, wherein the stiffener is made of a rigid load-bearing material;

inserting a second stiffener into another of the internal compartments; and mounting the flexible case to an upwardly-extending wall or wall structure residing inside a building structure at the construction site, by attaching or coupling the at least one pair of fastening devices to said wall or wall structure, such that a portion of the flexible case is disposed in an elevated, lateral orientation to thereby function as the workspace.

2. The method of claim 1 wherein the flexible case is formed of a waterproof material.

3. The method of claim 1 wherein the flexible case further comprises one or more storage pockets.

4. The method of claim 1 wherein the flexible case further comprises a handle.

5. The method of claim 1 further comprising the steps of removing the first stiffener from the internal compartment and rolling the flexible case into a compact storage position.

6. The method of claim 1 wherein the first stiffener is a piece of plywood.

7. An apparatus for providing a wall mountable workspace, the apparatus comprising:

a flexible case including a first panel and a second panel, the first and second panels being pivotally interconnected such that the first and second panels are operable to move between an open position and a closed position;

a pair of spaced apart hangers for hanging the flexible case from a vertical structure, said hangers connected to an upper edge of the first panel, said hangers extending vertically upward from the upper edge of the first panel such that when said hangers are hung from the vertical structure, the flexible case resides below the hangers;

a flap extending from the first panel, said flap securable to the second panel; and said second panel having an attachment location to which the flap is attachable;

wherein said flap operates to pass sequentially from said first panel and between the spaced apart hangers as they are hanging from the vertical structure and to the attachment location on the second panel, such that the first and second panels can be maintained in the closed position while the flexible case is attached to and hanging from the vertical structure.

8. The apparatus of claim 7 wherein each of the first and second panels comprises a stiffener.

9. The apparatus of claim 8 further comprising at least one opening in the flexible case for inserting and removing the stiffeners from each of the first and second panels.

10. The apparatus of claim 7 wherein each of the pair of spaced apart hangers comprises a tabbed portion.

11. The apparatus of claim 7 further comprising a handle connected to the flexible case.

12. The apparatus of claim 7 further comprising a plurality of storage pockets disposed on the flexible case.

13. The apparatus of claim 7 wherein the flexible case is collapsible into a rolled up position.

14. The apparatus of claim 7 further comprising at least one restraining member, said at least one restraining member operable to maintain one of the first and second panels in a substantially horizontal orientation.

15. The apparatus of claim 14 wherein the at least one restraining member is formed from a flexible material.

16. The apparatus of claim 14 wherein the at least one restraining member is formed from a rigid material.

* * * * *